United States Patent [19]

Sirinyan et al.

[11] Patent Number: 4,575,467

[45] Date of Patent: Mar. 11, 1986

[54] PROCESS FOR ACTIVATING SUBSTRATES FOR ELECTROLESS METALLIZATION

[75] Inventors: Kirkor Sirinyan, Bergisch Gladbach; Rudolf Merten, Leverkusen; Henning Giesecke, Cologne; Gerhard D. Wolf, Dormagen, all of Fed. Rep. of Germany

[73] Assignee: Bayer Aktiengesellschaft, Leverkusen, Fed. Rep. of Germany

[21] Appl. No.: 624,882

[22] Filed: Jun. 27, 1984

[30] Foreign Application Priority Data

Jul. 8, 1983 [DE] Fed. Rep. of Germany ..... 3324767

[51] Int. Cl.[4] ..... C23C 18/18; C23C 18/28

[52] U.S. Cl. ..... 427/304; 106/1.11; 427/8; 427/305; 427/306

[58] Field of Search ..... 427/304–306, 427/8; 106/1.11

[56] References Cited

U.S. PATENT DOCUMENTS 3,398,168 8/1968 Medema .
3,993,807 11/1976 Stabenow .
4,472,458 9/1984 Sirinyan et al. ..... 29/572

FOREIGN PATENT DOCUMENTS 0043485 1/1982 European Pat. Off. .

*Primary Examiner*—John D. Smith
*Attorney, Agent, or Firm*—Sprung Horn Kramer & Woods

[57] ABSTRACT

Complex compounds of elements of sub-groups 1 and 8 of the periodic table in oxidation stages 1–4 with unsaturated ketones of the formula

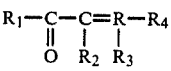

(I)

wherein $R_1$ and $R_4$ denote alkyl, cycloalkyl or aryl and $R_2$ and $R_3$ denote hydrogen or alkyl, are outstandingly suitable for activating substrate surfaces for electroless metallization since these complexes are distinguished by a high storage stability. The palladium complexes of but-3-en-2-one and hept-3-en-2-one are preferred.

6 Claims, No Drawings

PROCESS FOR ACTIVATING SUBSTRATES FOR ELECTROLESS METALLIZATION

The invention relates to a gentle process for activating non-conductive or semi-conductive substrate surfaces for electrochemical deposition of metals by means of solutions or dispersions of complex compounds of elements of sub-groups 1 and 8 of the periodic table.

Such methods have frequently been described in the literature.

Thus, for example, AT-A 286,058 proposes the use of complex compounds of amines, amides, carboxylic acids, ketones, olefins and many others.

From German Offenlegungsschrift 3,025,307, it is also known that the activation can be effected by means of complexes of nitriles, diketones and dienes.

According to German Offenlegungsschrift 2,116,389, complexes of N-containing compounds, for example pyridine derivatives, are recommended for this purpose.

Although excellent activation effects are in some cases achieved with these processes, even on uneven substrates and substrates which are sensitive to acid or alkali, they all have the serious disadvantage that the metal complex solutions used are not sufficiently stable on storage.

This also applies to the process according to German Offenlegungsschrift 2,451,217, in which solutions of a palladium-0 complex of di-unsaturated ketones, which additionally contain phosphites as n-donors and olefinically or acetylenically unsaturated compounds as $\pi$-acceptors for stabilisation of the system, are used for the activation. However, the catalytic action of the metal complexes is reduced by the addition of these extra complexing agents, so that the substrates to be activated must be subjected to expensive after-treatment with heat. Moreover, the palladium-0 complexes mentioned have the disadvantage that they are sufficiently soluble only in aromatics, some of which are very toxic, and not in the other solvents usual in this field, such as 1,1-dichloroethane, trichloroethylene, ethanol and cyclohexane.

Finally, all the gentle activation processes have the common fact that they use the abovementioned highly volatile solvents, which results in a continuous change in concentration of the activation baths.

It is thus understandable that the activation baths require continuous, careful monitoring. They must be supplemented with solvents and/or concentrate in order to ensure a uniform course of production.

The object of the present invention was thus to develop activators which are stable on storage and which can be continuously monitored by simple physical and/or chemical methods.

According to the invention, this object is achieved by using complex compounds of elements of sub-groups 1 and 8 of the periodic table in oxidation stages 1–4 with unsaturated ketones of the formula

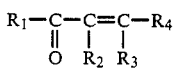

(I)

wherein $R_1$ and $R_4$ independently of one another denote an optionally substituted alkyl, cycloalkyl or aryl radical and $R_2$ and $R_3$ denote hydrogen or alkyl.

The complexes of the compounds of the formula I are distinguished by a good solubility in all the organic solvents customary in this field. They can be used in concentration ranges of from 0.001 g/liter up to the particular solubility limit. Preferably, 0.1–3.0 g/liter of these substances are used.

As a result of their high stability on storage (no clouding of the solutions—in some cases even after storage for weeks) and their high absorption in the ultraviolet and/or visible range of the spectrum, they are outstandingly suitable for continuous monitoring of the concentration of their solutions with a photometer.

Furthermore, the absorption properties of the complex compounds to be used according to the invention can be increased further by introducing specific substituents (in particular $NO_2$ and CN) into the radicals $R_1$ and $R_4$.

The influence of electron-attracting or electron-displacing substituents on the light absorption properties of carbon molecules is known and can be seen, for example, from D. H. Williams and J. Flemming "Spektroskopische Methoden in der organischen Chemie" ["Spectroscopic Methods in Organic Chemistry"], Georg Thieme Verlag Stuttgart (1971).

The complexes of the compounds of the formula I are known in some cases, or they can be obtained by methods which are known per se (compare Parshal and Wilkinson, "Inorganic Chemistry" 1, (1962), page 896), for example by adding a suitable aqueous solution of the noble metal salt to an excess of a compound of the formula I and bringing the complexing to completion at temperatures of 20°–150° C., preferably 60°–120° C.

After cooling, the complex precipitates in solid form. It is washed, dried and, if appropriate, recrystallised, and dissolved in a suitable solvent.

Examples of suitable metals for the preparation of the complexes are Pd, Pt, Ag and Au, palladium in the oxidation stage 1 being particularly preferred.

Suitable compounds of the formula I are, in particular, those in which "alkyl" represents $C_1$–$C_{20}$-alkyl radicals and "cycloalkyl" represents cyclohexyl radicals and "aryl" represents benzene radicals, it being possible for the alkyl radicals to be substituted by Cl, CN, $NO_2$, $C_1$–$C_4$-alkoxy or $C_1$–$C_4$-alkoxy-$C_1$–$C_4$-alkoxy, for the cycloalkyl radicals to be substituted by $CH_3$ and for the aryl radicals to be substituted by Cl, $N0_2$, $C_1$–$C_4$-alkyl or $C_1$–$C_4$-alkoxy.

Complexes which are particularly preferably to be used are derived from compounds of the formula I wherein $R_1$ and $R_4$ denote $C_1$–$C_{20}$-alkyl, preferably $C_1$–$C_6$-alkyl, and $R_2$ and $R_3$ denote hydrogen or $C_1$–$C_4$-alkyl, preferably methyl.

Examples which may be mentioned are: mesityl oxide, n-but-3-en-2-one, n-hept-3-en-2-one, n-hex-3-en-2-one, n-dec-4-en-3-one, 5-chloropent-3-en-2-one, ethyl vinyl ketone, 3-methyloct-5-en-4-one, 3-methylpent-3-en-2-one, 7-methoxyhept-3-en-2-one and cyclohex-2-enone.

In carrying out the new activation process in practice, a procedure is generally followed in which the substrate surfaces to be metallised are wetted with a dispersion or—preferably—a solution of the metal complex in a suitable organic solvent, the solvent is removed and, if necessary, sensitisation is carried out with a suitable reducing agent. The substrate thus pretreated can then be metallised in a usual metallising bath.

Apart from the abovementioned solvents, suitable solvents are perchloroethylene, acetone, methanol, butanol and dimethylformamide.

Suitable reducing agents for the sensitisation are aminoboranes, alkali metal hypophosphites and alkali metal borohydrides.

The substrates can be wetted by spraying, pressing, soaking or impregnating.

In order to increase the adhesion of the metal deposit on the carrier surface, solvents or solvent mixtures which lead to partial dissolving or swelling of the surface of the plastic to be metallised are particularly preferably used for carrying out the process according to the invention.

The solvents are removed from the wetted substrates simply by evaporation or, in the case of higher-boiling compounds, by extraction.

In a preferred process variant, the activation baths are monitored with a photometer as a detector. The wavelength of the filter here should correspond to any absorption maxima of the solution. The measurement signal is recorded in a compensation recorder in a cycle of 0.1 second up to several minutes called by a pulse generator. The missing components (solvent, activator) can thus be metered in with the aid of a computer.

In a very particularly preferred embodiment of the process according to the invention, the reduction in the metallising bath is carried out at the same time with the reducing agent of the electroless metallisation. This embodiment is especially suitable for nickel baths containing aminoborane or copper or silver baths containing formalin.

Baths containing Ni, Co, Cu, Au or Ag salts or mixtures thereof with one another or with iron salts can preferably be used as the metallising baths for the process according to the invention. Such baths are known in the art of electroless metallisation of plastics.

Suitable substrates for the process according to the invention are: steels, titanium, glass, aluminium, textiles and sheet-like structures based on natural and or synthetic polymers, ceramics, carbon, paper, thermoplastics, such as grades of polyamide, ABS (acrylonitrile butadiene/styrene) polymers, polycarbonates, polypropylene, polyesters, polyethylene, polyhydantoin, thermosets, such as epoxy resins and melamine resins, and mixtures or copolymers thereof.

Without restricting the scope of the process according to the invention, it is advisable to observe the following parameters when carrying out the process:

- The compounds used for activation of substrate surfaces should not lead to irreversible destruction of the metallisation bath.
- The substituents capable of absorbing light should not prevent fixing of the activators to the substrate surface.
- The substituents capable of absorbing light should not prevent complexing of the carrier molecule with the elements of sub-groups 1 and 8.
- The said elements should not undergo such a powerful interaction with $\alpha$, $\epsilon$-unsaturated compounds that they prevent catalysis for the chemical deposition of the metal.
- The solvents used should not exhibit intrinsic absorption in the absorption range of the activator, must be easily removable, and should not lead to chemical degradation of the organometallic compound or to complete solution of the substrates.

In order to achieve adequate activation, the activation time should be from a few seconds up to some minutes.

EXAMPLE 1

A 20×20 cm square of polyester film (100% polyethylene terephthalate) 0.2 mm thick is activated at room temperature for 30 seconds in an activation bath made up from 0.6 g of mesityl oxide-palladium chloride complex prepared in accordance with the statements of Parshal and Wilkinson (see page 3) and 1 liter of technical grade trichloroethene, and the film is dried at room temperature and then subjected to electroless nickeling for 15 minutes in an aqueous alkaline nickeling bath which contains, per liter, 30 g of $NiSO_4.6H_2O$, 11.5 g of citric acid, 18 ml of 2 N DMAB (dimethylaminoborane) solution and 2 g of boric acid and is adjusted to pH 8.5 with 25% strength ammonia solution. After about 45 seconds, the surface of the polymer begins to become grey-coloured, and after about 12 minutes, the test sample is covered with a glossy layer of nickel 0.15 μm thick.

EXAMPLE 2

A 140×250 mm injection-moulded sheet of ABS (acrylonitrile/butadiene/styrene graft copolymer from Bayer AG) is activated in a solution of 500 ml of technical grade methanol, 50 ml of technical grade trichloroethene and 0.4 g of mesityl oxide-palladium complex at room temperature for 5 minutes, dried at room temperature, sensitised in a reducing bath of 500 ml of ethanol and 50 ml of 2 N DMAB solution for 3 minutes and then nickeled at 33° C. in a conventional metallising bath from 81asberg GmbH and KG, 5650 Solingen. After only 4 minutes, the test sample is covered with a very fine deposit of nickel. After about 17 minutes, the chemical layer of nickel has an average thickness of about 0.20 μm. After the test sample has been removed from the chemical metallising bath and rinsed with distilled water, it is connected as the cathode in a conventional acid electroplating coppering bath and the coating is increased to a thickness of about 40 μm at 1.1 $A/dm^2$.

EXAMPLE 3

A 150×200 mm injection-moulded sheet of polyethylene terephthalate is activated at room temperature for 30 seconds in an activation bath made up from 0.4 g of mesityl oxide-platinum complex and 650 ml of tetrachloroethene, dried at room temperature and then nickeled according to Example 1. A sheet of polymer which has a metallic gloss and an electrically conductive nickel deposit ~0.15 μm thick is obtained.

EXAMPLE 4

A 150×300 mm rectangle of a cotton fabric is immersed for 30 seconds in a solution of 0.5 g of mesityl oxide-palladium chloride in 600 ml of methylene chloride, dried at room temperature and then nickeled in a reductive nickel bath according to Example 1 for 22 minutes.

After about 30 seconds, the surface begins to become dark-coloured, and after 5 minutes, a metal coating with a metallic gloss has been deposited.

EXAMPLE 5

A 120×120 mm square of a conventional polyester cotton mixed fabric is activated for 20 seconds according to Example 1, sensitised in a reducing bath according to Example 2, rinsed with distilled water and then coppered for 20 minutes in a chemical copper bath from Schering AG, Berlin (West). After only 5 minutes, an electrically conductive layer of copper which adheres well is deposited.

EXAMPLE 6

A sheet of ABS is activated at room temperature for 5 minutes in a bath made up from 500 ml of ethanol, 25 ml of pentane-2,4-dione and 0.4 g of n-hept-3-en-2one-palldium chloride, dried at 35° C. for 5 minutes and then nickeled according to Example 1 in the course of 20 minutes. After thickening by electroplating, the peel strength of the metal deposit is greater than the tear strength of the metal coating.

EXAMPLE 7

A sheet of polyamide 6,6 is activated according to Example 6 in an activation bath adjusted to pH 2.5 with concentrated hydrochloric acid, and is washed with distilled water, subsequently sensitised according to Example 2 and then metallised for 20 minutes. A sample with a metallic gloss and an adhesive metal deposit is obtained.

EXAMPLE 8

A 100×200 mm rectangle of a sheet of glass fibre-reinforced epoxy resin which is 2 mm thick, provided with perforations and laminated on both sides with Cu is immersed in an activation bath of 0.5 g of n-hept-3-en-2-one-palladium chloride in 1 liter of $CH_2C_{12}$, dried in air, sensitised according to Example 2 and then coppered according to Example 5 for 25 minutes. A through-plated board which has an electrically conductive Cu deposit and can be used for the production of printed circuit boards is obtained.

The heptenone complex is prepared as follows.

6 g of aqueous $Na_2PdCl_4$ solution containing 15% by weight of Pd are added dropwise to 20 g of freshly distilled n-hept-3-en-2-one at 110° C. in the course of 15 minutes and the mixture is stirred at the above temperature for 25 minutes and then cooled to 0° C. After 2 hours, the yellow precipitate is filtered off with suction, washed 3 times with 75 ml of distilled water each time and then twice with 50 ml of after-purified cold ethanol each time, dried, recrystallised from toluene/trichloroethylene (1:1) and dried overnight in vacuo in the drying cabinet. A pink-yellow crystalline solid of decomposition point 188° C. is obtained in 92% yield.

C: Cl: Pd:0=39.9:14.1:42.5:6.6 (determined)

C: Cl: Pd:0=33.1:14.0:41.9:6.3 (theoretical).

We claim:

1. Process for the activation of substrate surfaces for electroless metallisation by means of solutions or dispersions of complex compounds of Pd, Pt, Ag or Au, said solutions or dispersions having high stability on storage, characterized in that complex compounds of these elements in oxidation stages 1–4 with unsaturated ketones of the formula

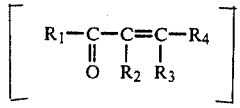

wherein, independently of one another, $R_1$ denotes a $C_1$–$C_6$-alkyl $R_2$ and $R_3$ denote hydrogen or $C_1$–$C_4$-alkyl, and $R_4$ denotes H or $C_1$–$C_6$-alkyl.

2. Process according to claim 1, characterised in that the solutions or dispersions are used without additional complexing agents of the series of donors and acceptors.

3. Process according to claim 1, characterised in that the complex compounds are used in concentrations of 0.1–3.0 g/liter of solvent.

4. Process according to claim 1, characterised in that in activated substrates are introduced into wet chemical metallising baths, especially Cu, Ni, Co, Ag and Au baths.

5. Process according to claim 1, characterised in that the concentration of the complex solutions in the activation baths is monitored continuously with a photometer.

6. Process according to claim 1, characterised in that the palladium complex of n-but-3-en-2-one is used.

* * * * *

UNITED STATES PATENT AND TRADEMARK OFFICE

CERTIFICATE OF CORRECTION

PATENT NO. : 4,575,467

DATED : March 11, 1986

INVENTOR(S) : Kirkor Sirinyan, et al.

It is certified that error appears in the above-identified patent and that said Letters Patent is hereby corrected as shown below:

| | |
|---|---|
| Col. 3, line 63 | Delete " ε -unsaturated" and substitute --ß-unsaturated-- |
| Col. 5, line 15 | Delete "2one" and substitute --2-one-- |
| Col. 6, line 21 | Delete brackets, that is, "[ ]" around formula |

Signed and Sealed this

*Fifth* Day of *August 1986*

[SEAL]

*Attest:*

DONALD J. QUIGG

*Attesting Officer*

*Commissioner of Patents and Trademarks*